US007695827B2

(12) United States Patent
Quadakkers et al.

(10) Patent No.: US 7,695,827 B2
(45) Date of Patent: Apr. 13, 2010

(54) COMPONENT WITH A PROTECTIVE LAYER

(75) Inventors: Willem J. Quadakkers, Wiinandsrade (NL); Werner Stamm, Mülheim an der Ruhr (DE)

(73) Assignee: Siemens Aktiengesellschaft, Munich (DE)

( * ) Notice: Subject to any disclaimer, the term of this patent is extended or adjusted under 35 U.S.C. 154(b) by 178 days.

(21) Appl. No.: 11/725,516

(22) Filed: Mar. 19, 2007

(65) Prior Publication Data

US 2008/0026242 A1 Jan. 31, 2008

Related U.S. Application Data

(63) Continuation-in-part of application No. 10/520,238, filed on Dec. 30, 2004, now Pat. No. 7,368,177.

(30) Foreign Application Priority Data

Mar. 24, 2006 (EP) ..... 06006109

(51) Int. Cl.
*B32B 15/00* (2006.01)
*B63H 1/26* (2006.01)

(52) U.S. Cl. ..... 428/678; 428/650; 428/652; 428/679; 428/680; 416/229 R; 416/241 R

(58) Field of Classification Search ..... 428/650, 428/652, 678, 679, 680; 416/229 R, 241 R
See application file for complete search history.

(56) References Cited

U.S. PATENT DOCUMENTS

| | | | | |
|---|---|---|---|---|
| 5,514,482 | A | 5/1996 | Strangman | |
| 5,792,521 | A | 8/1998 | Wortman | |
| 5,993,980 | A | 11/1999 | Schmitz et al. | |
| 6,221,181 | B1 | 4/2001 | Bossmann et al. | |
| 6,255,001 | B1 | 7/2001 | Darolia | |
| 6,287,644 | B1 | 9/2001 | Jackson et al. | |
| 6,660,405 | B2 * | 12/2003 | Lau et al. | 428/613 |
| 6,924,045 | B2 * | 8/2005 | Khan et al. | 428/678 |
| 2002/0098294 | A1 * | 7/2002 | Lau et al. | 427/454 |
| 2002/0187336 | A1 * | 12/2002 | Khan et al. | 428/323 |
| 2003/0054196 | A1 * | 3/2003 | Lau et al. | 428/655 |
| 2003/0207151 | A1 | 11/2003 | Stamm | |
| 2004/0180233 | A1 | 9/2004 | Stamm | |
| 2005/0164026 | A1 | 7/2005 | Quadakkers et al. | |
| 2005/0238893 | A1 * | 10/2005 | Quadakkers et al. | 428/469 |
| 2005/0238907 | A1 * | 10/2005 | Quadakkers et al. | 428/680 |

FOREIGN PATENT DOCUMENTS

| | | |
|---|---|---|
| EP | 1 082 216 B1 | 3/2001 |
| EP | 1 204 776 B1 | 5/2002 |
| EP | 1 306 454 A1 | 5/2003 |
| EP | 1 319 729 A1 | 6/2003 |

(Continued)

*Primary Examiner*—Timothy M Speer
*Assistant Examiner*—Gordon R Baldwin

(57) ABSTRACT

The invention relates to a component having a substrate and a protective layer, which consists of an intermediate NiCoCrAlY layer zone on or near the substrate and an outer layer zone which is arranged on the intermediate NiCoCrAlY layer zone, which is characterized in that the intermediate NiCoCrAlY layer zone comprises of (in wt %): 24-26% Co, 16-18% Cr, 9.5-11% Al, 0.3-0.5 Y, 1-1.8% Re and Ni balance.

17 Claims, 3 Drawing Sheets

FOREIGN PATENT DOCUMENTS

| | | | |
|---|---|---|---|
| EP | 1 319 730 | A1 | 6/2003 |
| EP | 1 380 672 | A1 | 1/2004 |
| EP | 1 411 148 | A1 | 4/2004 |
| EP | 1 411 210 | A1 | 4/2004 |
| EP | 1 491 650 | A1 | 12/2004 |
| EP | 1 491 659 | A1 | 12/2004 |
| WO | WO 99/67435 | A1 | 12/1999 |
| WO | WO 00/44949 | A1 | 8/2000 |

* cited by examiner

COMPONENT WITH A PROTECTIVE LAYER

CROSS REFERENCE TO RELATED APPLICATIONS

This application claims the benefits of European application No. 06006109.0 filed Mar. 24, 2006, which is incorporated by reference herein in its entirety. This application is a continuation-in-part of U.S. application Ser. No. 10/520,238, published as United States Patent Application Publication US 2005/0238907 and filed Dec. 30, 2004, now U.S. Pat. No. 7,368,177 B2.

FIELD OF INVENTION

The invention relates to a component having a substrate and a protective layer, which consists of an intermediate NiCoCrAlY layer zone on or near the substrate and an outer layer zone, which is arranged on the intermediate NiCoCrAlY layer zone.

BACKGROUND OF THE INVENTION

Metallic compounds, which are exposed to high temperature must be protected against heat and corrosion. This is especially true for parts of gas turbines like combustion chambers, turbine blades or vanes. These parts are commonly coated with an intermediate MCrAlY layer (M=Fe, Co, Ni) and a thermal barrier coating (TBC) which is applied on top of the intermediate layer. Between the two layers an aluminium oxide layer is formed due to oxidation.

The bonding of the three different layers is crucial for high durability of the protection layer as a whole. Problems may arise, if there are big differences in the thermal expansion factors of the different layers. In this case failure of the thermal barrier coating might occur, which can lead to the destruction of the whole compound.

From U.S. Pat. No. 6,287,644 a continuously graded MCrAlY bond coat is known which has a continuously increasing amount of Cr, Si or Zr with increasing distance from the underlaying substrate in order to reduce the thermal mismatch between the bond coat and the thermal barrier coating by adjusting the thermal expansion factors.

The U.S. Pat. No. 5,792,521 shows a multi layer thermal barrier coating.

U.S. Pat. No. 5,514,482 discloses a thermal barrier coating system for super alloy components, in which the MCrAlY layer is substituted by an aluminium coating layer such as NiAl. In order to obtain the desired properties the NiAl layer has to be quite thick because of its brittleness.

From EP 1 082 216 B1 a MCrAlY layer is known, which has the γ-phase at its outer layer. This γ-phase can only be obtained by remelting or deposition from a liquid phase in an expensive way.

EP 1 380 672 A1 discloses a highly oxidation resistant component with a protective layer, which consists of an intermediate MCrAlY layer zone and an outer layer zone, which has the structure of the phase β-NiAl.

The layer systems mentioned above are either expensive or lack a strong bonding between the different layer zones.

SUMMARY OF INVENTION

It is thus an object of the present invention to describe a component having a substrate and a protective layer, which possesses a high oxidation resistance and a strong bonding between the different layer zones.

This object is met by components having an intermediate NiCoCrAlY layer zone, which comprises of (in wt %): 24-26% Co, 16-18% Cr, 9.5-11% Al, 0.3-0.5% Y, 1-1.8% Re and Ni balance.

Surprisingly it was found that an intermediate NiCoCrAlY layer zone of this composition is able to form an extraordinary strong bonding to the substrate and to the outer layer zone. As a result the protective layer shows a high oxidation resistance and a good durability. Furthermore it can be applied to a substrate in an easy way by known methods.

As alternatives to the above solution the intermediate NiCoCrAlY layer zone may have one of the following compositions (in wt %):

11-13% Co, 20-23% Cr, 10.5-11.5% Al, 0.3-0.5% Y, 1.0-2.5% Re and Ni base, or 29-31% Ni, 26.5-29.5% Cr, 6.5-9.5% Al, 0.2-1.0% Y and 0.5-1.1% Si and Co base, or 27-29% Ni, 22.5-25.5% Cr, 9-11% AL; 0.1-1.1% Y and Co base, or 11-13.5% Co, 19.5-23% Cr, 9-12% Al, 0.1-0.8% Y, 1-3.2% Re and Ni base, or 9-11% Co, 21-24% Cr, 11-14% Al, 0.2-0.9% Y and Ni base.

In one preferred embodiment the outer layer zone consists at least of the elements Ni and Al and possesses the structure of the phase β-NiAl.

It is also possible that the outer layer zone is a MCrAlY layer, which has the structure of the phase γ-Ni and a content of aluminium of up to 6.5 wt %. In this case M can either be Co or Ni or both Co and Ni. In one preferred embodiment of the invention the outer layer zone can comprise of (in wt %) 15-40% Cr, 5-80% Co, 3-6.5% Al and Ni balance.

The protective layer can consist of two separate layer zones and it is possible that the outer layer zone is thinner than the intermediate layer zone.

According to one preferred embodiment of the invention Y is at least partly replaced in the intermediate NiCoCrAlY layer zone by at least one element selected from the group: Si, Hf, Zr, La, Ce or other elements from the Lanthanide group.

Experiments have shown that an intermediate NiCoCrAlY layer zone, which further contains (in wt %) 0.1-2% Si and/or 0.2-8% Ta, shows an even better bonding of the outer layer zone. In this coherence it was also found that a thickness between 50 to 600 μm and preferably 100 to 300 μm is an optimal thickness of the intermediate layer zone.

The outer layer zone can contain at least one element selected from the group: Cr, Co, Si, Re and Ta. It is also possible that the outer layer zone contains one or more additional elements chosen from: Hf, Zr, La, Ce, Y and other elements from the Lanthanide group. Good results were achieved if the maximum amount of these additional elements did not surmount 1 wt %.

An outer layer zone, which comprises of (in wt %) 10-20% Cr, 10-30% Co, 5-6% Al and Ni balance showed good results in experiments.

The outer layer zone can have a thickness between 3-100 μm, preferably 3-50 μm.

The component according to the invention can be a part of a gas turbine like a turbine blade, a turbine vane or a heat shield. In this case an excellent protection of the turbine part against corrosion is achieved. This seems to be due to the strong bonding between the substrate and the protection layer.

BRIEF DESCRIPTION OF THE DRAWINGS

In the following the invention will be explained in more detail with reference to the attached drawings. In the drawings.

DETAILED DESCRIPTION OF INVENTION

The invention may be embodied in many different forms and should not be construed as limited to the illustrated embodiments set forth herein. Rather, the illustrated embodiments are provided so that this disclosure will be through and complete, and will fully convey the scope of the invention to those skilled in the art.

Figure 1:
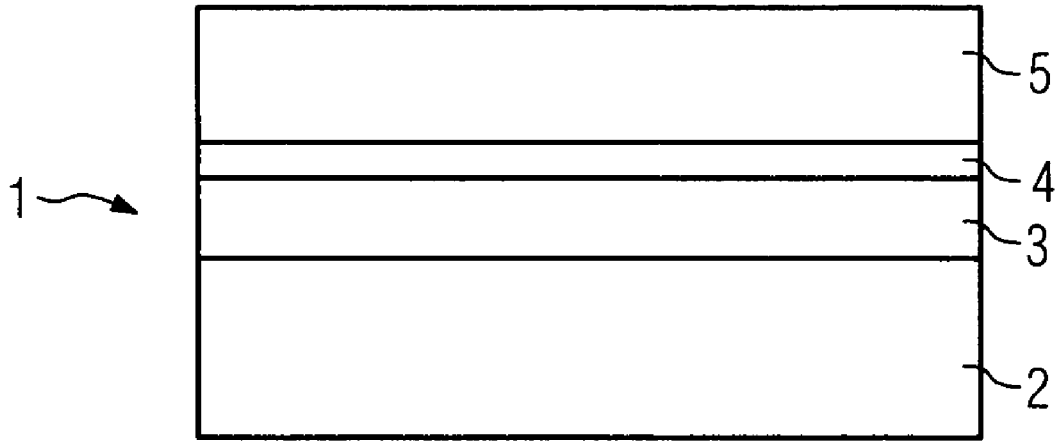
FIG. 1 shows a heat resistant component known from the art.

FIG. 1 shows a heat resistant component 1 known in the art. It comprises a substrate 2 which is coated with a MCrAlY layer 3. A thermally grow oxide layer (TGO) 4 is provided on the MCrAlY layer 3. The oxide layer 4 is covered by an outer thermal barrier coating (TBC) 5.

Figure 2:
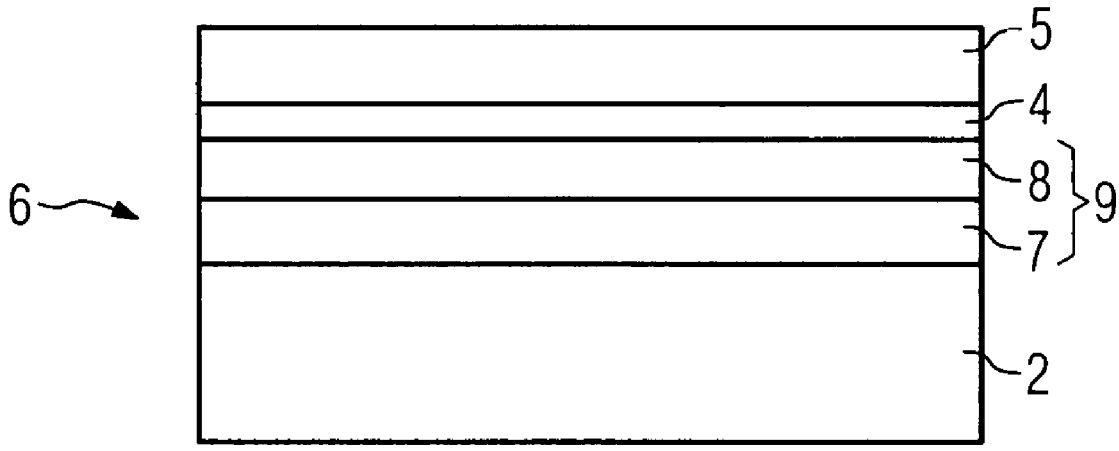
FIG. 2 shows an oxidation resistant component according to the invention.

FIG. 2 shows an oxidation resistant component 6 according to the invention which can be a part of a gas turbine, like a turbine blade or vane or a heat shield. Component 6 comprises a substrate 2 which can consist of a metal or an alloy, e.g. a super alloy. An intermediate NiCoCrAlY layer zone 7 is provided on the substrate 2. It has a composition (in wt %) of 24-26% Co, 16-18% Cr, 9.5-11% Al, 0.3-0.5% Y, 1.0-1.8% Re and Ni base of balance. The NiCoCrAlY layer 7 may contain 0.1-2% Si and/or 0.2-8% Ta.

It is possible that the NiCoCrAlY layer zone 7 contains additional elements like Hf, Zr, La, Ce or other elements of the lanthanide group. These elements can also replace part of the Y in the layer 7. The intermediate NiCoCrAlY layer zone 7 is approximately 200 μm thick but its thickness can be from 50 to 600 μm.

An outer layer zone 8 is provided on of the intermediate layer zone 7. This outer layer zone 8 consists of the elements Ni and Al and possesses the structure of the phase β-NiAl. It is also possible that the outer layer zone is a MCrAlY layer having the structure of the phase γ-Ni. In this case it may have a content of aluminium of up to 6.5 wt % and M may be Co or Ni or both of them.

Further elements like Cr, Co, Si, Re, Ta, Hf, Zr, La, Ce, Y and other elements from the Lanthanide group can also be included in the outer layer zone 8.

The outer layer zone 8 is 15 μm thick and thus thinner than the intermediate NiCoCrAlY layer zone 7 while the thickness can be in the range of 3 to 100 μm. Both layers 7, 8 can be applied by plasma spraying (VPS, APS) or other conventional coating methods. Together they from a protective layer 9.

The outer layer zone 8 is covered by a thermally grown oxide layer (TGO) 4, which can consist of a metastable aluminium oxide, preferably having the θ-phase or a mixture of the θ- and the γ-phase.

To improve the formation of desired metastable aluminium oxide the oxidation of the outer layer zone 8 should take place at a temperature between 850° C. and 1000° C., especially between 875° C. and 925° C. for 2 h-100 h, especially between 5 h and 15 h. Further improvements are possible, if water vapour (0.2-50 vol %, especially 20-50 vol. %) is added to the oxidation atmosphere or if an atmosphere is used which has a low oxygen partial pressure between 800° C. and 1100° C., especially between 850° C. and 1050° C. In addition to water vapour the atmosphere can also contain non-oxidating gases such as a nitrogen, aragon or helium.

If the TGO 4 consists of metastable aluminium oxide it can have a needlelike structure which ensures a strong bonding between the TGO 4 and a thermal barrier coating 5 being provided on the TGO 4.

The component 6 can be part of a gas turbine for example a turbine blade, a turbine vane or a heat shield.

Figure 3:
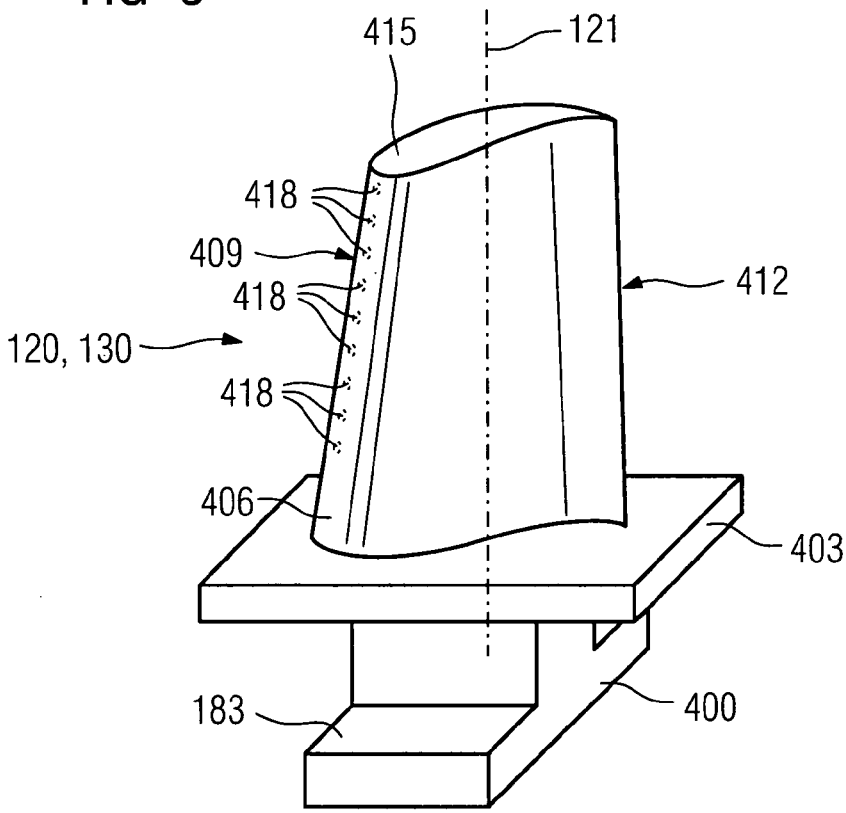
FIG. 3 shows a blade or a vane.

FIG. 3 shows a perspective view of a blade or vane 120, 130 which extends along a longitudinal axis 121. Along the longitudinal axis 121, the blade or vane 120, 130 has, in succession, a securing region 400, an adjoining blade or vane platform 403 and a main blade region 406. A blade root 183 which is used to secure the rotor blades 120, 130 to the shaft is formed in the securing region 400. The blade or vane root 183 is designed as a hammer head. Other configurations, for example as a fir-tree root or a dovetail root, are possible. In the case of conventional blades or vanes 120, 130, solid metallic materials are used in all regions 400, 403, 406 of the rotor blade 120, 130. The rotor blade 120, 130 may in this case be produced using a casting process, a forging process, a milling process or a combination thereof.

Figure 4:
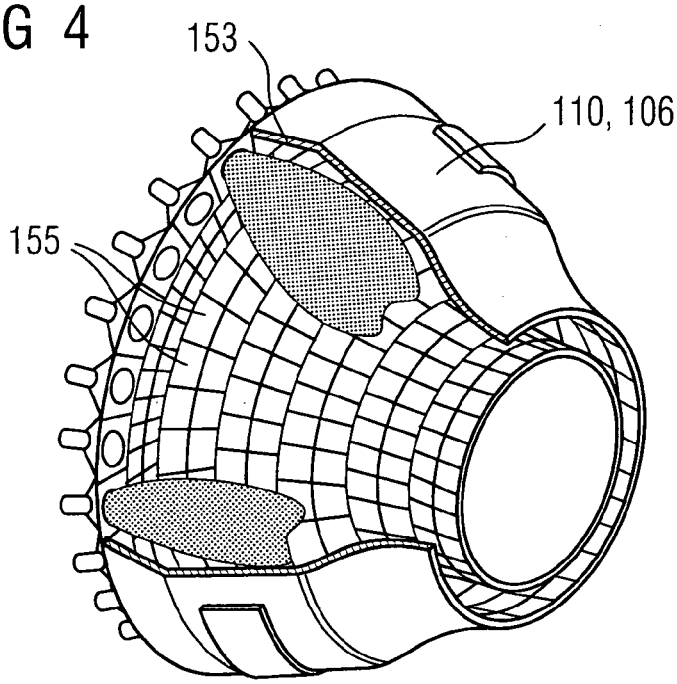
FIG. 4 shows a combustion chamber.

FIG. 4 shows a combustion chamber 110 of a gas turbine. The combustion chamber 110 is designed, for example, as what is known as an annular combustion chamber, in which a multiplicity of burners 107 arranged around the turbine shaft in the circumferential direction open out into a common burner chamber space. For this purpose, the overall combustion chamber 110 is configured as an annular structure which is positioned around the turbine shaft.

To achieve a relatively high efficiency, the combustion chamber 110 is designed for a relatively high temperature of the working medium M of approximately 1000° C. to 1600° C. To allow a relatively long service life to be achieved with these operating parameters, which are unfavourable for the materials, the combustion chamber wall 153 is provided, on its side facing the working medium M, with an inner lining formed from heat shield elements 155. On the working medium side, each heat shield element 155 is equipped with a particularly heat-resistant protective layer or is made from material which is able to withstand high temperatures. Moreover, on account of the high temperatures in the interior of the combustion chamber 110, a cooling system is provided for the heat shield elements 155 and/or their holding elements.

The materials used for the combustion chamber wall and its coatings may be similar to the turbine blades or vanes 120, 130.

The combustion chamber 110 is designed in particular to detect losses of the heat shield elements 155. For this purpose, a number of temperature sensors 158 are positioned between the combustion chamber wall 153 and the heat shield elements 155.

Figure 5:
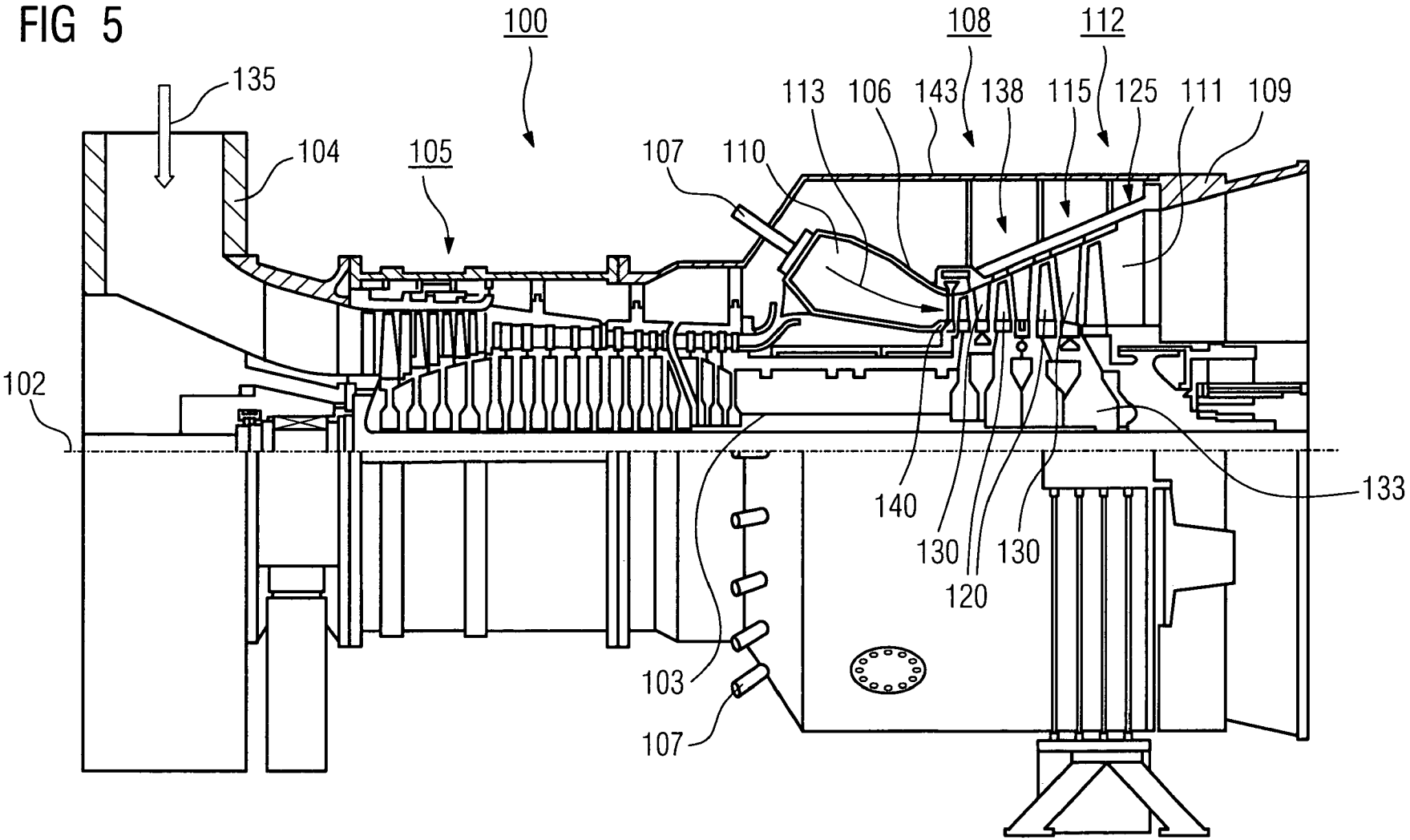
FIG. 5 shows a gas turbine.

FIG. 5 shows, by way of example, a gas turbine 100 in partial longitudinal section.

In the interior, the gas turbine 100 has a rotor 103 which is mounted such that it can rotate about an axis of rotation 102.

An intake housing 104, a compressor 105, a, for example torus-like combustion chamber 110, in particular an annular combustion chamber 106, having a plurality of coaxially arranged burners 107, a turbine 108 and the exhaust-gas housing 109 follow one another along the rotor 103.

The annular combustion chamber 106 is in communication with an, for example annular, hot-gas passage 111, where, for example, four turbine stages 112 connected in series form the turbine 108.

Each turbine stage 112 is formed from two rings of blades or vanes. As seen in the direction of flow of a working medium 113, a row 125 formed from rotor blades 120 follows a row 115 of guide vanes in the hot-gas passage 111.

The guide vanes 120 are in this case secured to an inner housing 138 of a stator 143, whereas the rotor blades 120 of a row 125 are arranged on the rotor 103 by way of example by means of a turbine disk 133. A generator or machine (not shown) is coupled to the rotor 103.

While the gas turbine 100 is operating, the compressor 105 sucks in air 135 through the intake housing 104 and compresses it. The compressed air provided at the turbine-side end of the compressor 105 is passed to the burners 107, where it is mixed with a fuel. The mixture is then burnt in the combustion chamber 110, forming the working medium 113.

From there, the working medium 113 flows along the hot-gas passage 111 past the guide vanes 130 and the rotor blades 120. The working medium 113 expands at the rotor blades 120, transmitting its momentum, so that the rotor blades 120 drive the rotor 130 and the latter drives the machine coupled to it.

While the gas turbine 100 is operating, the components exposed to the hot working medium 113 are subject to thermal loads. The guide vanes 130 and rotor blades 120 belonging to the first turbine stage 112, as seen in the direction of flow of the working medium 113, are subject to the highest thermal loads apart from the heat shield blocks which line the annular combustion chamber 106.

To enable them to withstand the prevailing temperatures, they are cooled by means of a coolant.

The substrates may also have a directional structure, i.e. they are in single-crystal form (SX structure) or comprise only longitudinally directed grains (DS structure).

Iron-base, nickel-base or cobalt-base superalloys are used as the material.

By way of example, superalloys as known from EP 1 204 776, EP 1 306 454, EP 1 319 729, WO 99/67435 or WO 00/44949 are used; these documents form part of the present disclosure.

The blades or vanes 120, 130 may also have coatings protecting them from corrosion (MCrAlY; M is at least one element selected from the group consisting of iron (Fe), cobalt (Co), Nickel (Ni), Y represents yttrium (Y) and/or silicon (Si) and/or at least one rare earth) and to protect against heat by means of a thermal barrier coating. The thermal barrier coating consists, for example, of $ZrO_2$, $Y_2O_3$—$ZrO_2$, i.e. it is not stabilized, is partially stabilized or is completely stabilized by yttrium oxide and/or calcium oxide and/or magnesium oxide.

Columnar grains are produced in the thermal barrier coating by suitable coating processes, such as electron beam physical vapor deposition (EB-PVD).

The guide vane 130 has a guide vane root (not shown here) facing the inner housing 138 of the turbine 108 and a guide vane head on the opposite side from the guide vane root. The guide vane head faces the rotor 103 and is fixed to a securing ring 140 of the stator 143.

The invention claimed is:

1. A component, comprising:

a component substrate; and a protective layer arranged on the substrate, including:

an intermediate NiCoCrAlY layer zone arranged near the substrate, wherein the intermediate NiCoCrAlY layer zone is comprised of (in wt %): 24-26% Co, 16-18% Cr, 9.5-11% Al, 0.3-0.5 Y, 1.0-1.8% Re and Ni balance;

an outer layer zone arranged on the intermediate NiCoCrAlY layer zone comprising the elements Ni and Al and having a phase β-NiAl structure; and a ceramic thermal barrier coating arranged on the outer layer zone, wherein the ceramic thermal barrier coating is suitable for exposure to a 1600° C. working fluid.

2. The component according to claim 1, wherein the outer layer zone comprises (in wt %): 15-40% Cr, 5-80% Co, 3-6.5% Al and Ni balance.

3. The component according to claim 2, wherein the protective layer consists of two separated layer zones.

4. The component according to claim 3, wherein the outer layer zone is thinner than the intermediate NiCoCrAlY layer zone.

5. The component according to claim 4, wherein in the intermediate NiCoCrAlY layer zone Yttrium is at least partly replaced by an element selected from the group consisting of: Si, Hf, Zr, La, Ce and other Lanthanide group elements.

6. The component according to claim 5, wherein the intermediate NiCoCrAlY layer zone further contains (in wt %): 0.1-2% Si and/or 0.2-8% Ta.

7. The component according to claim 6, wherein the intermediate NiCoCrAlY layer zone has a thickness of 50 to 600 μm.

8. The component according to claim 5, wherein the intermediate NiCoCrAlY layer zone has a thickness of 100 to 300 μm.

9. The component according to claim 8, wherein the outer layer zone comprises at least one element selected from the group consisting of: Cr, Co, Si, Re and Ta.

10. The component according to claim 9, wherein the outer layer zone contains an additional element selected from the group: Hf, Zr, La, Ce, Y and other elements from the Lanthanide group.

11. The component according to claim 10, wherein the maximum amount of the additional element is 1 wt %.

12. The component according to claim 2, wherein the outer layer zone comprises of (in wt %): 10-20% Cr, 10-30% Co, 5-6% Al and Ni balance.

13. The component according to claim 12, wherein the outer layer zone has a thickness between 3 to 100 μm.

14. The component according to claim 12, wherein the outer layer zone has a thickness between 3 to 50 μm.

15. The component according to claim 14, wherein the component is a turbine blade, turbine vane, or a heat shield.

16. A component having a substrate and a protective layer, comprising:

an intermediate NiCoCrAlY layer zone on or near the substrate, wherein the intermediate NiCoCrAlY layer zone is comprised of 24-26 (wt %) Co, 16-18% Cr (wt %), 9.5-11% Al (wt %), 0.3-0.5 Y (wt %), 1.0-1.8 Re (wt %) and balance Ni;

an outer layer zone arranged on the intermediate NiCoCrAlY layer zone comprising the elements Ni and Al and having a phase β-NiAl structure; and a ceramic thermal barrier coating arranged on the outer layer zone, wherein the ceramic thermal barrier coating is suitable for exposure to a 1600° C. working fluid.

17. The component as claimed in claim 16, wherein the intermediate NiCoCrAlY layer zone further contains (in wt %): 0.1-2% Si or 0.2-8% Ta.

* * * * *